United States Patent [19]

Villaseca et al.

[11] Patent Number: 4,982,197

[45] Date of Patent: Jan. 1, 1991

[54] DUAL MODE LOG PERIODIC DIPOLE ANTENNA

[75] Inventors: Eduardo H. Villaseca, Costa Mesa; Mark L. Wheeler, Fullerton; Donald G. Keppler, Huntington Beach, all of Calif.

[73] Assignee: Hughes Aircraft Company, Los Angeles, Calif.

[21] Appl. No.: 284,033

[22] Filed: Dec. 14, 1988

[51] Int. Cl.[5] ..... H01Q 11/10

[52] U.S. Cl. ..... 343/792.5; 343/878

[58] Field of Search ..... 343/792.5, 801, 878; 342/427

[56] References Cited

U.S. PATENT DOCUMENTS

| | | | |
|---|---|---|---|
| 3,257,661 | 6/1966 | Tanner | 343/792.5 |
| 3,765,022 | 10/1973 | Tanner | 343/792.5 |
| 4,355,315 | 10/1982 | Zoulek | 343/792.5 |
| 4,604,628 | 8/1986 | Cox | 343/818 |

OTHER PUBLICATIONS

Published by the American Radio Relay League, The ARRL Antenna Book, 15th edition, 1988, Chapter 7, p. 7.

Alvis J. Evans, Antennas Selection and Installation, p. 5.

*Primary Examiner*—Michael C. Wimer

*Attorney, Agent, or Firm*—Wanda K. Denson-Low

[57] ABSTRACT

Dual mode log periodic dipole antenna apparatus which provides for sum and difference radiation patterns depending on the method of excitation. The antenna incorporates a support structure which secures a plurality of radiators having three elements with successively incresing length. The center and right dipole elements of each radiator and the center and left elements of each radiator are alternately coupled together by separate transmission lines in a crisscross fashion. Input ports coupled to the smallest radiator and driven with a conventional hybrid coupler with either in-phase or out-of-phase energy at either λ/2 or λ. Sum and difference radiation patterns are achieved by appropriate selection of the excitation phase. Thus, this antenna may be employed in monopulse or direction finding applications. An alternative embodiment is disclosed which employs center radiator elements offset from the right and left elements of their respective radiators.

19 Claims, 6 Drawing Sheets

HYBRID COUPLER
20
22a
22b
24
24a
24b
26
28
29
30
32

DUAL MODE LOG PERIODIC DIPOLE ANTENNA

This invention was made with Government support under Contract No. DAAB10-87-C-0029 awarded by the Department of the Army. The Government has certain rights in this invention.

BACKGROUND OF THE INVENTION

The present invention relates generally to log periodic dipole antennas and more specifically to a dual mode log periodic dipole antenna which is capable of producing sum and difference patterns for dipole element lengths of one-half wavelength and one wavelength respectively.

Log periodic dipole antenna structures are well known in the antenna art. A discussion of such structures may be found in "Broadband Logarithmically Periodic Antenna Structures," R. H. DuHamel et al, 1957 *IRE National Convention Record*, Part 1, pages 119–128, and "Log Periodic Dipole Arrays," *IRE Trans. Antenna Propag.*, Vol. AP-8, pages 260–267, May 1960.

However, for use in monopulse and direction finding applications, two separate log periodic arrays are necessary to provide direction finding capability across the VHF band. Such antenna systems are typically bulky and the electrical characteristics of the two antenna are hard to match. In addition, single mode dipole antennas radiate only sum patterns and cannot provide phase information which is necessary in target detection applications.

SUMMARY OF THE INVENTION

In order to overcome the limitations of conventional single mode dipole antennas operating in a dual mode environment, the present invention provides for a dual mode log periodic dipole antenna 20 which is capable of producing a directional sum pattern and which can also produce a difference pattern to determine the direction of arrival of incident energy. The antenna comprises a nonconducting support structure having a plurality of dipole antenna radiators of successively increasing length attached to the support structure.

The antenna 20 tapers outwardly from an apex located at the input end thereof. Each radiator has separate left, center and right radiator elements extending transverse to a longitudinal axis of the antenna. The right and center element of each radiator correspond to a first dipole antenna array, and the respective center and left elements of each radiator correspond to a second dipole antenna array.

Two input ports are provided at the input end of the arrays, one coupled to the right and center elements of a selected input radiator, and the other coupled to corresponding left and center elements of the input radiator. A first transmission line interconnects alternate right and center elements of each radiator of the first dipole array, and a second transmission line interconnects alternate center and left elements of each radiator of the second dipole array.

A hybrid coupler is used to transfer energy into and out of the antenna and is configured to provide in-phase and out-of-phase energy to the input ports. The antenna is fed in series at each input port and produces sum and difference patterns depending upon the excitation scheme.

In one embodiment, the dipole elements in each section are colinear and the arrays are coplanar. In a second embodiment, the left and right dipole elements are colinear and coplanar while the center elements are disposed parallel to their respective radiator elements but are offset therefrom. The center elements are disposed in a plane which is parallel to the plane containing the left and center dipole elements.

The dipole antenna provides sum and difference patterns over a broad bandwidth while maintaining adequate input impedance. The antenna may be operated as a direction finding antenna in the HF, VHF or UHF regions of the electromagnetic spectrum. This antenna eliminates the need for two conventional dipole antennas normally required for direction finding applications.

BRIEF DESCRIPTION OF THE DRAWING

The various features and advantages of the present invention may be more readily understood with reference to the following detailed description taken in conjunction with the accompanying drawings, wherein like reference numerals designate like structural elements, and in which.

DETAILED DESCRIPTION

Figures 1A, 1B, 1C:
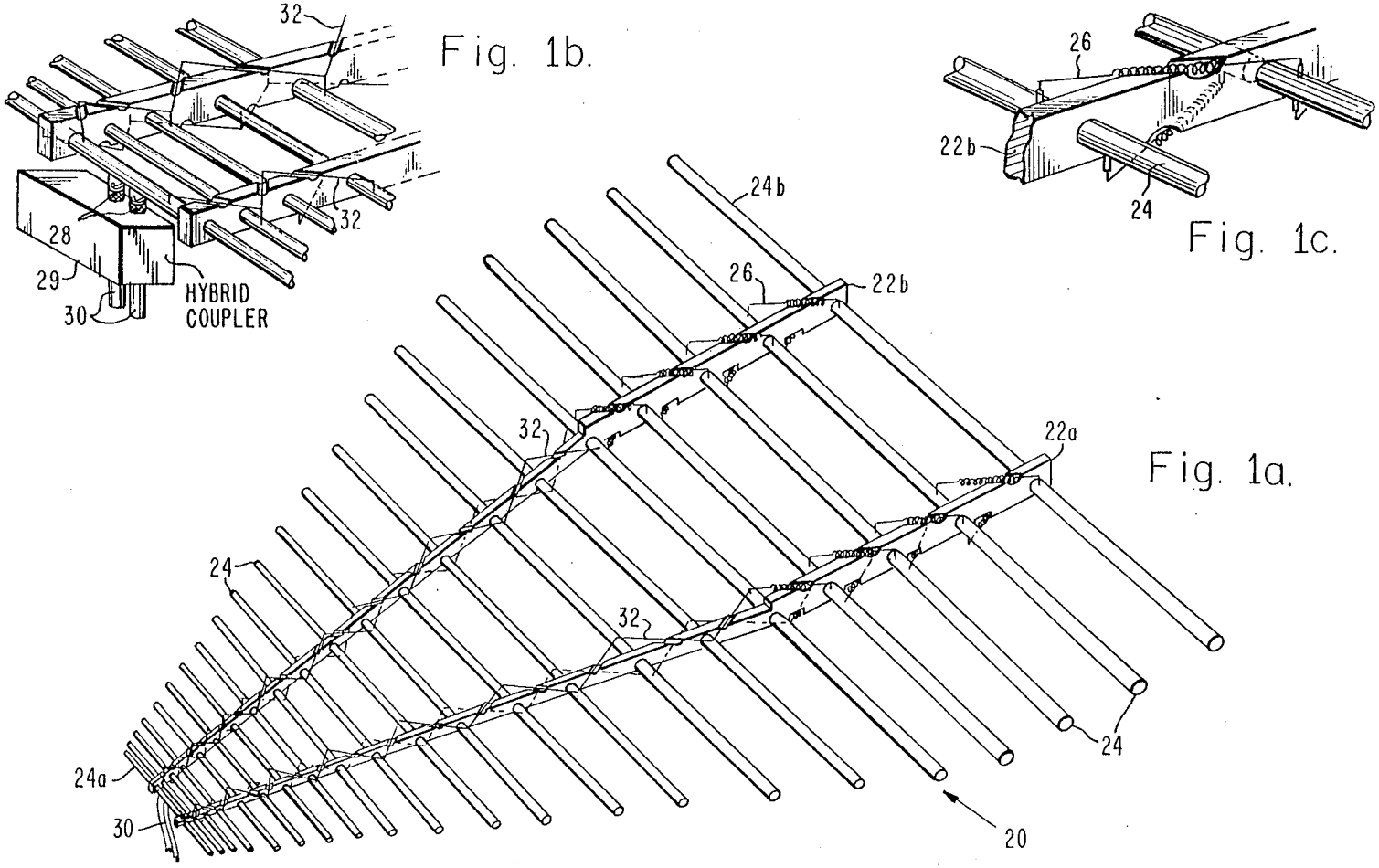
FIGS. 1*a–c* illustrates one embodiment of a dual mode log periodic dipole antenna in accordance with the principles of the present invention.

Referring to FIG. 1*a*, there is shown one embodiment of a dual mode log periodic dipole antenna 20 in accordance with the principles of the present invention. The antenna 20 comprises a nonconducting support structure, which may be a dielectric material such as epoxy fiberglass, for example. The support structure is comprised of two longitudinal support members 22*a*, 22*b*, to which are attached a plurality of dipole radiators 24. The dipole radiators 24 are comprised of a conducting material such as aluminum, for example.

Each of the dipole radiators 24 are comprised of three colinear conducting rods, or wires, designated for reference as the left, center and right radiator elements. The right and center dipole radiator elements of each radiator 24 comprise a first dipole array, while the left and center dipole radiating elements of each radiator comprise a second dipole array. Each of the radiators 24 is constructed in a similar three part fashion.

The electrical length of each of the radiators 24 increases starting with a first radiator 24*a*, which is the input radiator of the antenna 20, located at the front end of the antenna 20 and ending with the last radiator 24*b* at the opposite end of the antenna 20. The physical length of each of the radiators also increases along the length of the antenna, except for several of the longest radiators. To facilitate packaging the antenna 20 compactly, the radiators which radiate the longest wavelength radiation are physically shortened and electronically lengthened by means of inductive elements 26. The inductive elements 26 are more clearly shown in FIG. 1c.

Located at the front end of the antenna 20 at the first radiator 24a are two conventional input ports 28 which are well known in the art and which will not be discussed in detail. The first or input radiator 24a having the two input ports 28 may be configured as a sleeve dipole or as a twin lead dipole. The two input ports 28 are separately coupled to individual transmission lines that are used to interconnect the radiating elements of each antenna array. In particular, and with reference to FIG. 1b, each transmission line comprises a plurality of conductive elements 32 which connect alternating right and center radiator elements of the respective array in a crisscross fashion.

Specifically, connections are made between the center radiator element of the first radiator to the right radiator element of the second radiator, which in turn is connected to the center radiator element of the third radiator, and so forth. Similarly the right radiator element of the first radiator is connected to the center radiator element of the second radiator, which in turn is connected to the right radiator element of the third radiator, and so forth. The left and center radiator elements are interconnected in a similar manner.

A conventional hybrid coupler 29, which is well known in the art, and which will not be discussed herein, is coupled to the input ports 28 in order to couple energy into and out of the antenna 20. A conventional coaxial or twin lead transmission line 30 is coupled to the hybrid coupler 29 to provide a link to a transmitter or receiver coupled to the antenna 20.

The antenna 20 of the present invention may be operated in the HF, VHF or UHF regions of the electromagnetic spectrum. The antenna 20 is well suited for use as a direction finding antenna.

Regarding the general operation of the antenna 20, the radiation response thereof is similar to the response produced when a single dipole antenna is excited by two separate feedlines. The two feedlines are disposed equidistant from the ends of each radiator.

By operating both feedlines with in-phase energy, the radiator resonates at $L = \lambda/2$ and produce a current distribution characteristic of the common center fed $\lambda/2$ dipole radiator. However, when both feedlines are energized with 180° out of phase energy, the radiator resonates at $L=\lambda$ and produces a current distribution characteristic of a $\lambda$ dipole radiator. These characteristic current distributions produce a sum pattern for the in-phase case and a difference pattern for the out-of-phase case.

The design considerations for the antenna 20 are controlled by the following equations. The geometrical dimensions of each radiator increase logarithmically and are defined by the inverse of the geometric ratio $\tau$, defined by:

$$\frac{1}{\tau} = \frac{L_{n+1}}{L_n} = \frac{R_{n+1}}{R_n} = \frac{d_{n+1}}{d_n} = \frac{D_{n+1}}{d_n} = \frac{D_{N+1}}{D_n}$$

where L is the element length, R is the distance of the element along the array from the apex, d is the spacing between elements, D is the diameter of the elements, and n is the nth element. In addition to the above, the spacing factor is defined as:

$$\sigma = \frac{d_n}{2L_n}$$

From the immediately preceding equation the apex angle of the antenna 20 can be determined, and may be expressed as:

$$\alpha = 2\tan^{-1}\left(\frac{1-\tau}{4\sigma}\right)$$

The alternating feedlines employed in the antenna 20 creates a 180° phase shift in the energy between radiating elements. This phase shift produces a phase progression that allows energy to be directed from the antenna 20 in the direction of the shorter radiators.

The antenna of FIG. 1 utilizes a variable $\tau$ design in accordance with the theory outlined in "Reduced Size Log Periodic Antennas," The Microwave Journal, Vol. VII. No. 12, pp. 37–42, December 1964. The design parameters for this antenna were chosen such that $\tau=0.87$, $\sigma=0.06$, and $\alpha=56.9°$. The design initially comprised 20 elements with the three longest elements having a mechanically shortened length, but inductive loading was included to increase their electrical length.

However, in order to provide for an additional low frequency element within the array length, a $\tau$ of 0.97 was chosen for the seven longest elements. This increased $\tau$ was applied to the element spacing and not to their lengths. This permitted the effective $\alpha$ angle to remain constant. Therefore, the antenna design ultimately comprised 21 elements having the four electrically longest elements mechanically shortened and inductively loaded. In addition, the lowest frequency element was resistively loaded for impedance matching purposes in a manner well known in the art.

Figure 2A:
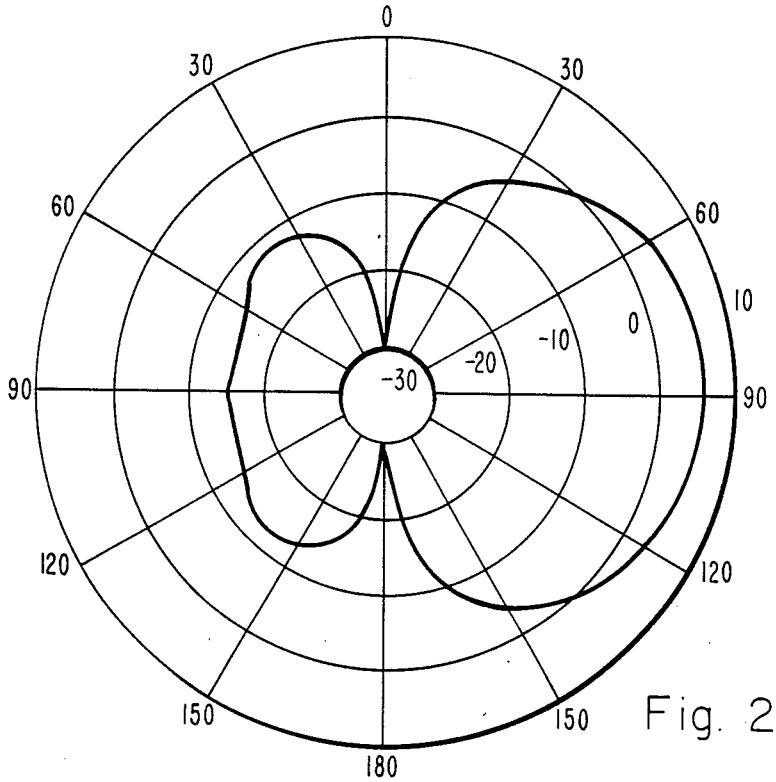
FIGS. 2*a–c* show graphs representing radiation patterns provided by the antenna of FIG. 1.
Figure 2B:
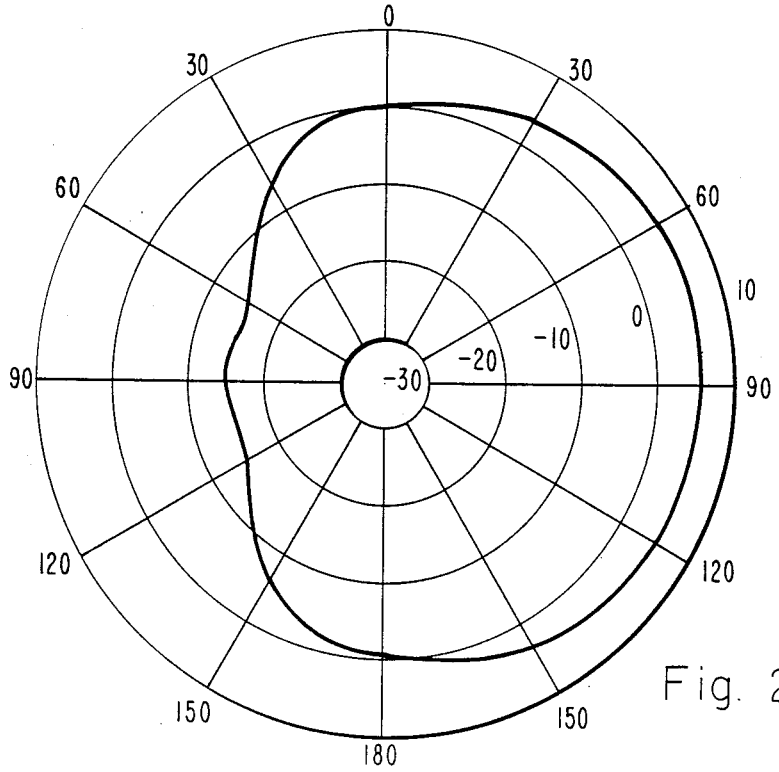
Figure 2C:
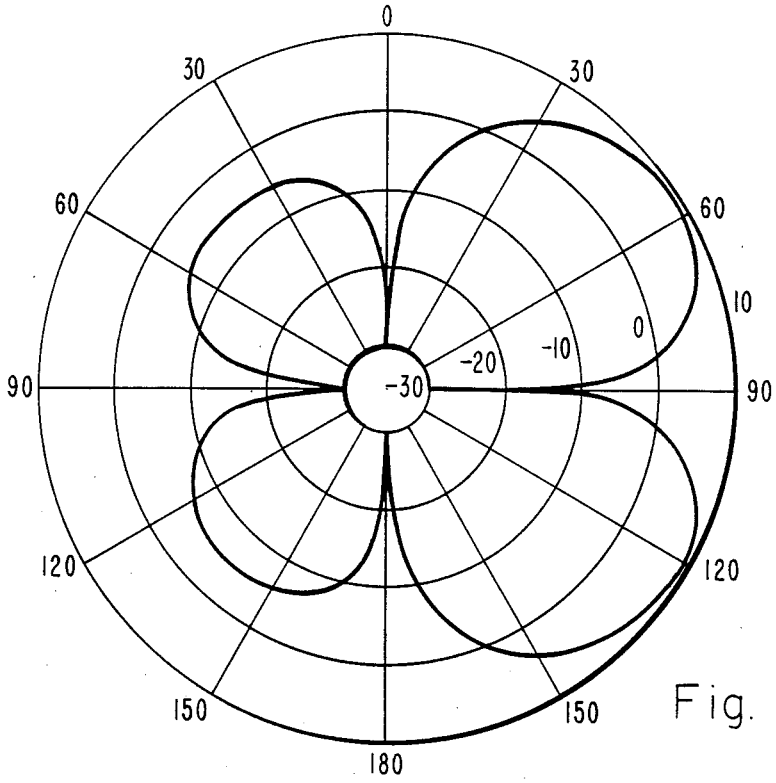

The above-described embodiment was analyzed using a computer simulation program known as the Numerical Electrical Code (NEC3) simulation program to predict the performance characteristics of the design. This program was developed by the U.S. Navy, and can be obtained from the Naval Research Center in Monterey, Calif. FIG. 2a shows a typical midband E-plane sum pattern. The maximum gain at boresight is 6.1 dBi. The pattern has a 3 dB beamwidth of 70.0° and a front-to-back ratio of 20.4 dB. The corresponding H-plane pattern is shown in FIG. 2b. This pattern has a 3 dB beamwidth of 132°. FIG. 2c shows a typical E-plane difference pattern. The maximum gain is 5.49 dBi located at 33.0° off boresight. The graphs of FIG. 2 are power patterns calibrated in dBi.

Figure 3A:
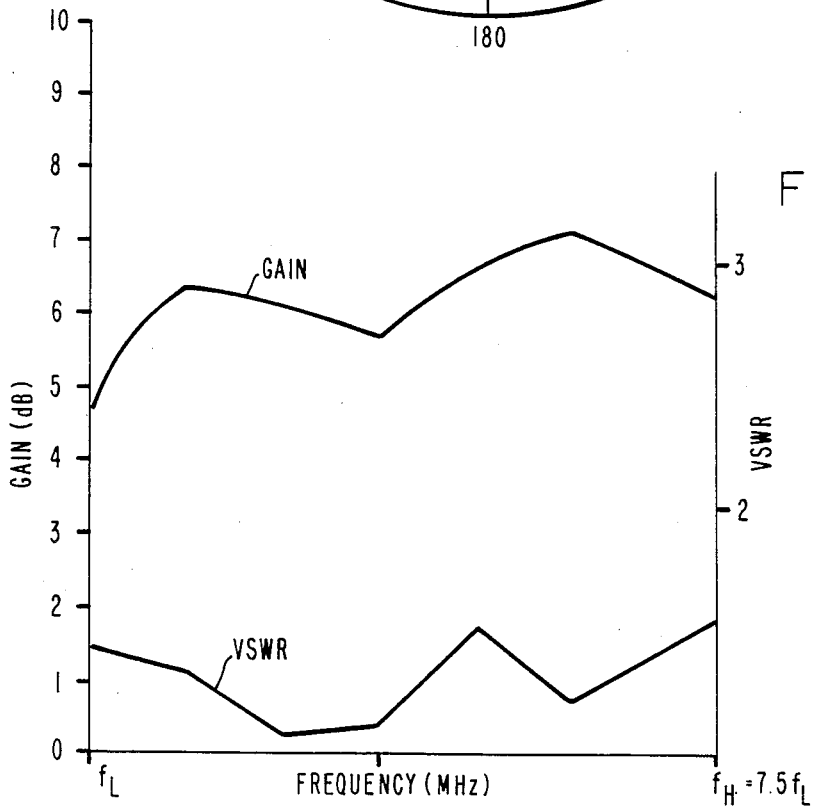
FIGS. 3*a* and *b* illustrate the sum mode gain and VSWR and difference mode gain and VSWR, respectively, for the antenna of FIG. 1.
Figure 3B:
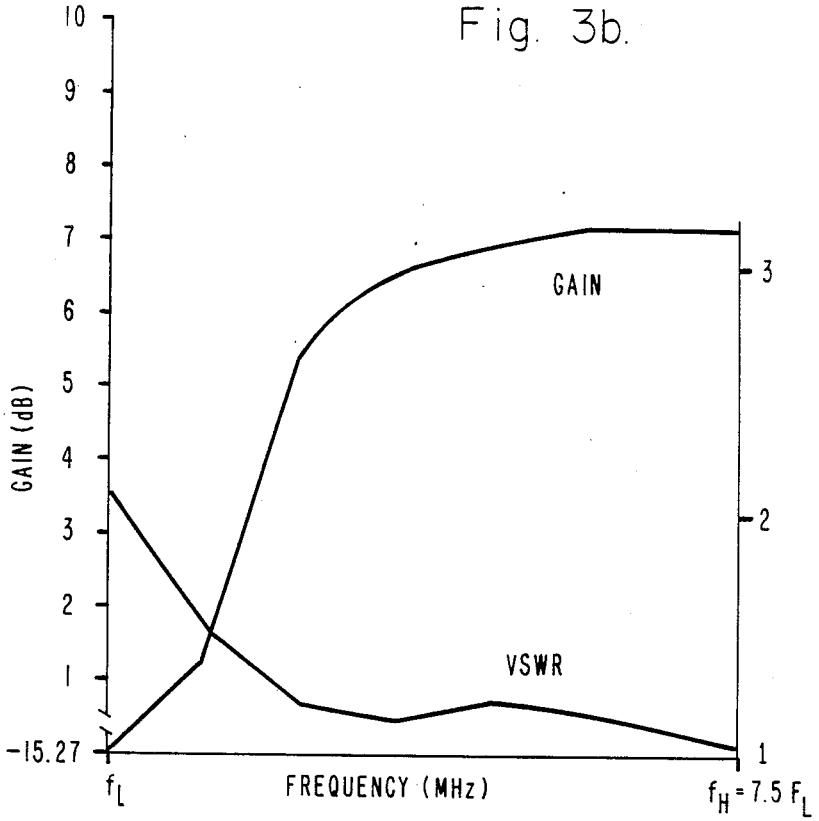

FIG. 3a shows sum mode VSWR (voltage standing wave ratio) and gain over the frequency band. The VSWR is less than 2.0:1 over the entire band and a gain of 6.0 dBi or higher is typical over most of the band. FIG. 3b shows the difference pattern VSWR and gain. Again, VSWR is less than 2.0:1 except at the very low end of the frequency band. Gain over the upper half of the band is 6.0 dBi or greater. However, the gain drops off sharply at the low end due to the resistive loading of the longest element.

Figure 4A:
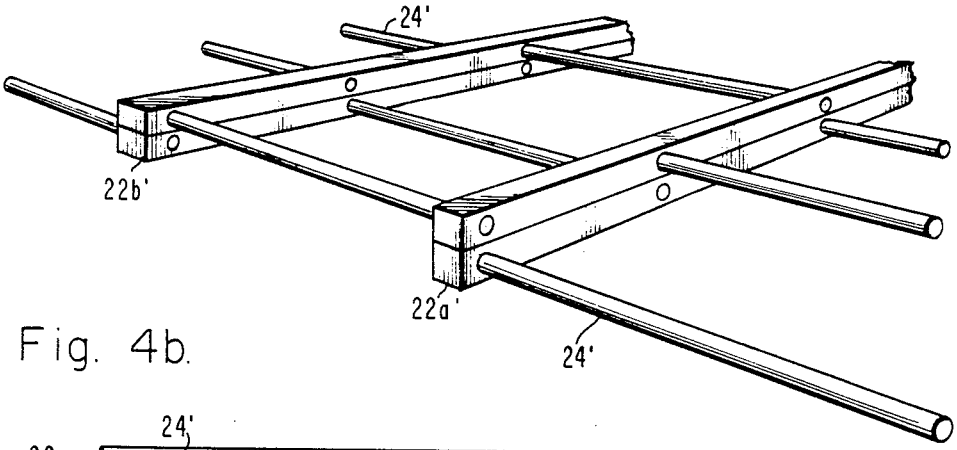
FIGS. 4*a* and 4*b* illustrate top and side views, respectively, of 2 second embodiment of a dual mode log periodic dipole antenna in accordance with the principles of the present invention.
Figure 4B:
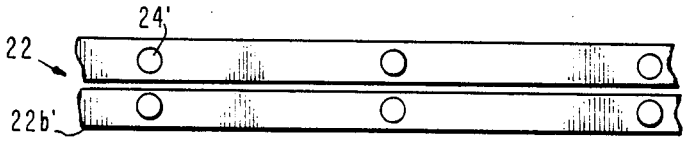

With reference to FIGS. 4a and 4b, they illustrate top and side views, respectively, an alternative embodiment of an antenna 22 in accordance with the principles of the present invention. In this antenna, the center radiator elements of each of the radiators 24' are displaced transversely from the right and left elements of the radiator. The center elements are coplanar, and the left and right elements of the radiators are also coplanar. Appropriate modifications to the support structure 22a', 22b' are necessary to support the center radiators. However, it is considered a simple matter to make such alterations, and as such they will not be discussed in detail.

Figure 5:
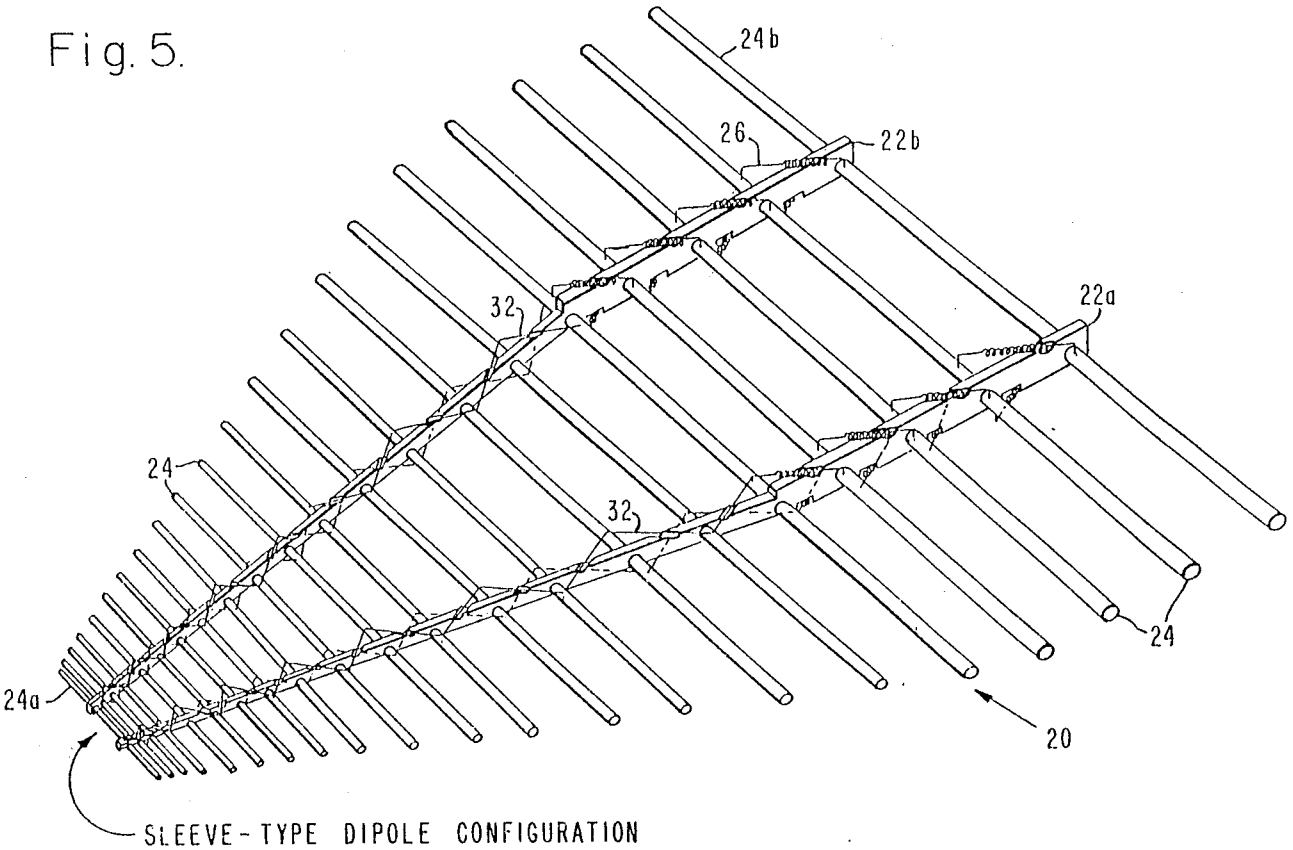
FIG. 5 is a perspective view of an embodiment of a dual mode log periodic antenna of the present invention in which the input radiator is of a sleeve-type dipole configuration.
Figure 6:
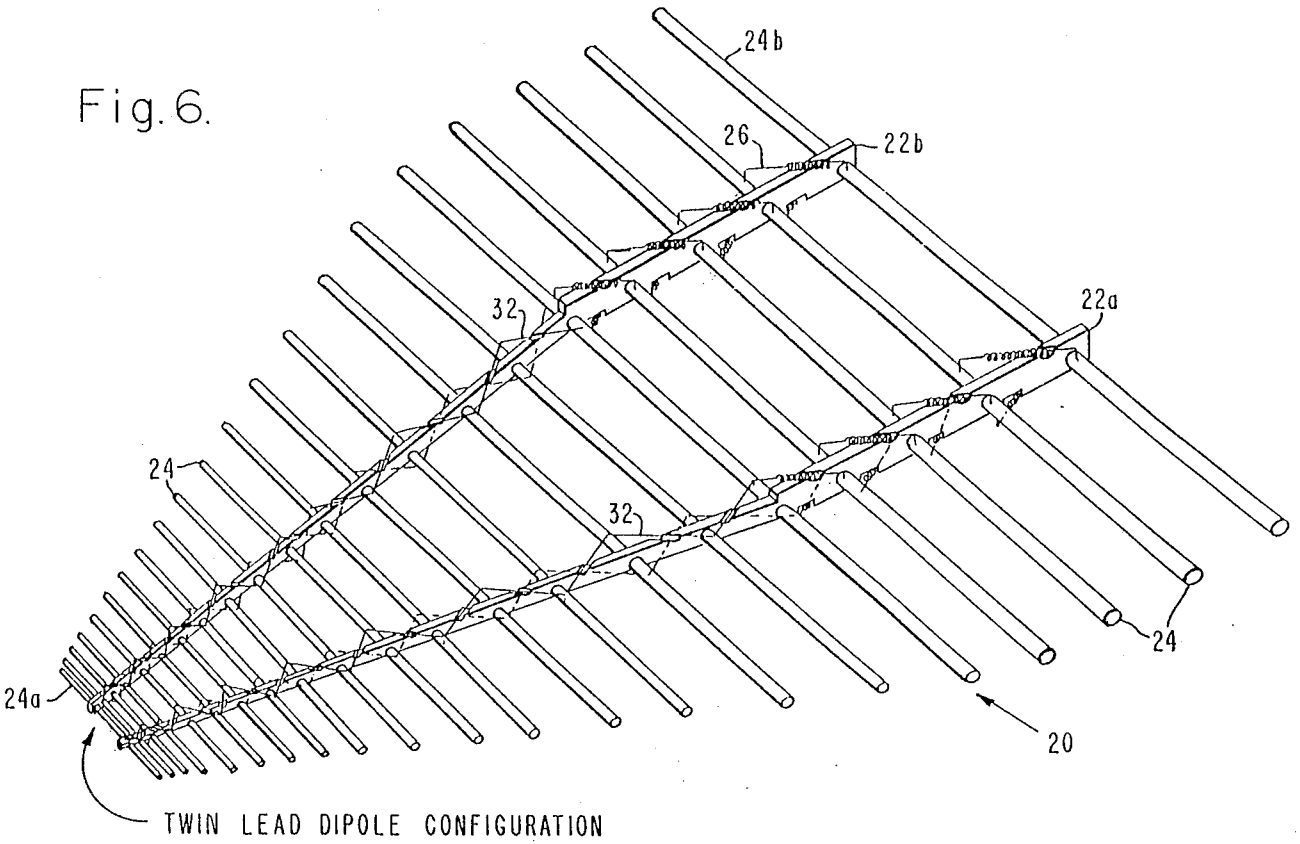
FIG. 6 is a perspective view of an embodiment of a dual mode log periodic antenna of the present invention in which the input radiator is of a twin lead dipole configuration.

FIG. 5 shows an embodiment of a dual mode log periodic antenna 20 in which the input radiator is of a sleeve-type dipole configuration; while FIG. 6 shows an embodiment in which the input radiator is of a twin lead dipole configuration.

Accordingly, there has been disclosed a new and improved dipole antenna which provides for sum and difference patterns over a broad bandwidth while maintaining an adequate input impedance. The antenna may be operated as a direction finding antenna in the HF, VHF or UHF regions of the electromagnetic spectrum. This antenna eliminates the need for two conventional dipole antennas normally required for direction finding applications.

It is to be understood that the above-described embodiments are merely illustrative of some of the many and varied specific embodiments which represent applications of the principles of the present invention. Clearly, numerous and varied other arrangements may be readily designed by those skilled in the art without departing from the scope of the invention.

What is claimed is:

1. A dual mode log periodic dipole antenna comprising:

a nonconducting support structure;

a plurality of dipole radiators of successively increasing length attached to the support structure, each radiator having separate left, center and right radiator elements extending transverse to a longitudinal axis of the antenna, the right and left radiator elements of each respective dipole radiator having substantially the same length, the respective right and center radiator elements of each radiator corresponding to a first dipole array, and the respective center and left elements of each radiator corresponding to a second dipole array;

two input ports, one coupled to the right and center elements of a selected radiator, and the other coupled to left and center elements of the selected radiator;

a first transmission line conductively interconnecting alternate right and center elements of each radiator of the first array; and a second transmission line conductively interconnecting alternate center and left elements of each radiator of the second array.

2. The antenna of claim 1 wherein the left, center and right elements of each radiator are substantially colinear.

3. The antenna of claim 2 wherein the plurality of radiators are substantially coplanar.

4. The antenna of claim 1 wherein the left, center and right elements of each radiator are substantially colinear and the plurality of radiators are substantially coplanar.

5. The antenna of claim 1 wherein the left and right elements of each radiator are substantially colinear and the center elements of each radiator are parallel to their corresponding right and left elements and are separated therefrom by a predetermined distance.

6. The antenna of claim 4 wherein the right and left elements of each of the radiators are substantially coplanar and the center elements of each of the radiators are substantially coplanar.

7. The antenna of claim 1 wherein the selected radiator to which each of the input ports is coupled comprises a sleeve-type dipole configuration.

8. The antenna of claim 1 wherein the selected radiator to which each of the input ports is coupled comprises a twin lead dipole configuration.

9. The antenna of claim 1 further comprising a hybrid coupler conductively coupled to each of the input ports and configured to provide in-phase and out-of-phase energy to the input ports and employed to transfer energy into and out of the antenna.

10. The antenna of claim 1 wherein the first and second transmission lines are connected at locations on each dipole radiator defined by L/3 and 2L/3, where L is the length of each dipole array.

11. The antenna of claim 1 wherein the first and second transmission lines are disposed equidistant from the respective ends of each dipole radiator and from each other.

12. A dual mode log periodic dipole antenna comprising:

a nonconducting support structure;

a plurality of dipole radiators of successively increasing length attached to the support structure, each radiator having separate left, center and right radiator elements extending transverse to a longitudinal axis of the antenna, the right and left radiator elements of each respective dipole radiator having substantially the same length, the respective right and center radiator elements of each radiator corresponding to a first dipole array, and the respective center and left elements of each radiator corresponding to a second dipole array, the left and right elements of each radiator are substantially colinear and mutually coplanar, and the center elements of each radiator are mutually coplanar and disposed parallel to their corresponding right and left elements and separated a predetermined distance therefrom;

two input ports, one coupled to the right and center elements of a selected radiator, and the other coupled to left and center elements of the selected radiator;

a first transmission line conductively interconnecting alternate right and center elements of each radiator of the first array; and a second transmission line conductively interconnecting alternate center and left elements of each radiator of the second array.

13. The antenna of claim 12 wherein the selected radiator to which each of the input ports is coupled comprises a sleeve-type dipole configuration.

14. The antenna of claim 12 wherein the selected radiator to which each of the input ports is coupled comprises a twin lead dipole configuration.

15. The antenna of claim 12 further comprising a hybrid coupler conductively coupled to each of the input ports and configured to provide in-phase and out-of-phase energy to the input ports and employed to transfer energy into and out of the antenna.

16. A dual mode log periodic dipole antenna comprising:

a nonconducting support structure;

a plurality of coplanar dipole radiators of successively increasing length attached to the support structure, each radiator having separate and colinear left, center and right radiator elements extending transverse to a longitudinal axis of the antenna, the right and left radiator elements of each respective dipole radiator having substantially the same length, the respective right and center radiator elements of each radiator corresponding to a first dipole array, and the respective center and left elements of each radiator corresponding to a second dipole array;

two input ports, one coupled to the right and center elements of a selected radiator, and the other coupled to left and center elements of the selected radiator;

a first transmission line conductively interconnecting alternate right and center elements of each radiator of the first array; and a second transmission line conductively interconnecting alternate center and left elements of each radiator of the second array.

17. The antenna of claim 16 wherein the selected radiator to which each of the input ports is coupled comprises a sleeve-type dipole configuration.

18. The antenna of claim 16 wherein the selected radiator to which each of the input ports is coupled comprises a twin lead dipole configuration.

19. The antenna of claim 16 further comprising a hybrid coupler conductively coupled to each of the input ports and configured to provide in-phase and out-of-phase energy to the input ports and employed to transfer energy into and out of the antenna.

* * * * *